United States Patent [19]

Burkhardt

[11] Patent Number: 4,713,507

[45] Date of Patent: Dec. 15, 1987

[54] KEY OPERATED SWITCH FOR KEYBOARD

[76] Inventor: Gottfried Burkhardt, Am Bahndamm 29, D8501 Winkelhaid, Fed. Rep. of Germany

[21] Appl. No.: 914,786

[22] Filed: Oct. 3, 1986

[51] Int. Cl.[4] ..... H01H 13/52

[52] U.S. Cl. ..... 200/159 A; 200/5 A; 200/292; 200/340; 200/250

[58] Field of Search ..... 200/292, 159 R, 159 A, 200/5 A, 5 R, 340, 290, 250, 245, 159 B

[56] References Cited

U.S. PATENT DOCUMENTS

| | | | |
|---|---|---|---|
| 4,029,916 | 6/1977 | Chu | 200/5 A |
| 4,084,071 | 4/1978 | Smith | 200/5 A |
| 4,341,934 | 7/1982 | Muller | 200/159 A |
| 4,365,408 | 12/1982 | Ditzig | 200/159 B X |
| 4,370,533 | 1/1983 | Kamei et al. | 200/340 |

FOREIGN PATENT DOCUMENTS

| | | | |
|---|---|---|---|
| 2537905 | 3/1977 | Fed. Rep. of Germany . | |
| 2612452 | 9/1977 | Fed. Rep. of Germany . | |
| 3036336 | 4/1982 | Fed. Rep. of Germany | 200/159 R |
| 3225696 | 1/1984 | Fed. Rep. of Germany . | |

*Primary Examiner*—Charles E. Phillips
*Assistant Examiner*—Ernest G. Cusick

[57] ABSTRACT

A key operated switch for keyboards having an improved layer type construction comprising a key carrier and key return spring supporting printed circuit conductors and contacts so arranged as to facilitate fully automatic production of keyboards. The simple formation of a leaf spring, a key guide and the key stem comprising the switch enables these parts also to be assembled by machine, making the manufacture of a keyboard simple and inexpensive.

1 Claim, 2 Drawing Figures

KEY OPERATED SWITCH FOR KEYBOARD

FIELD OF THE INVENTION

This invention relates to key operated switches for keyboards having printed circuits and switch contacts.

BACKGROUND OF THE INVENTION

DE No. 30 36 336 relates to a key operated switch with a key return spring of special design. This arrangement makes a particularly simple construction of a switch of flat design possible. Two tongues of this specially designed spring cause the resetting of the key shaft while a third tongue of the spring serves to close the contact. In copending U.S. application Ser. No. 811,437, filed December 20, 1985, a further development of an above mentioned switch is disclosed. Therein, conductors and switch contacts on a key carrier are designed as printed conductors; insulating coatings taking care that the conductors are insulated electrically. No insulation is present in certain places defining switch contacts to make contact closing possible.

SUMMARY OF THE INVENTION

It is an object of the invention to improve and reduce the cost of the key operated switch disclosed in said copending application. According to the invention, one conductor can be printed on the key carrier in a relatively simple manner while the other conductor is disposed on the underside of the spring tongue carrier. The conductors are laid down at right angles to each other so that the required connections to the power supply or to the electronics of a machines will not hinder each other. Further, in accordance with the invention switch contact points on the conductors are ungraded by noble metal coatings so that good contacts are achieveable at very high switching frequencies.

The spring tongue carrier is expediently produced of spring steel sheet and first printed or coated with required layers comprising a printed conductor sandwiched between insulating layers. Thereafter, the required cutouts are stamped out in a stamping operation. If several such touch contact switches are assembled to form a keyboard it suffices to use a single spring steel sheet for the spring tongue carrier. It can then be joined to the key carrier in another operation, e.g. by screwing or welding, resulting in one structural unit. It is of further advantage that the spacing to the contact points to be closed can be kept very small. The down travel of the key required for the operation of a keyboard, e.g., for typewriters, is expediently placed into the stroke of the key ram or controller. The tongues of the spring tongue carrier, acting as return springs, will then result in a good keying feel. For the rest, the actuation of the contact spring tongue takes place in accordance with the features of the aforementioned DE No. C2 30 36 366.

Other objects, features and advantages of the present invention will bedome better known to those skilled in the art from a reading of the following detailed description when taken in conjunction with the accompanying drawing wherein like reference numerals designate like or corresponding elements throughout the several views thereof and wherein:

DETAILED DESCRIPTION OF THE PREFERRED EMBODIMENTS

Figure 1:
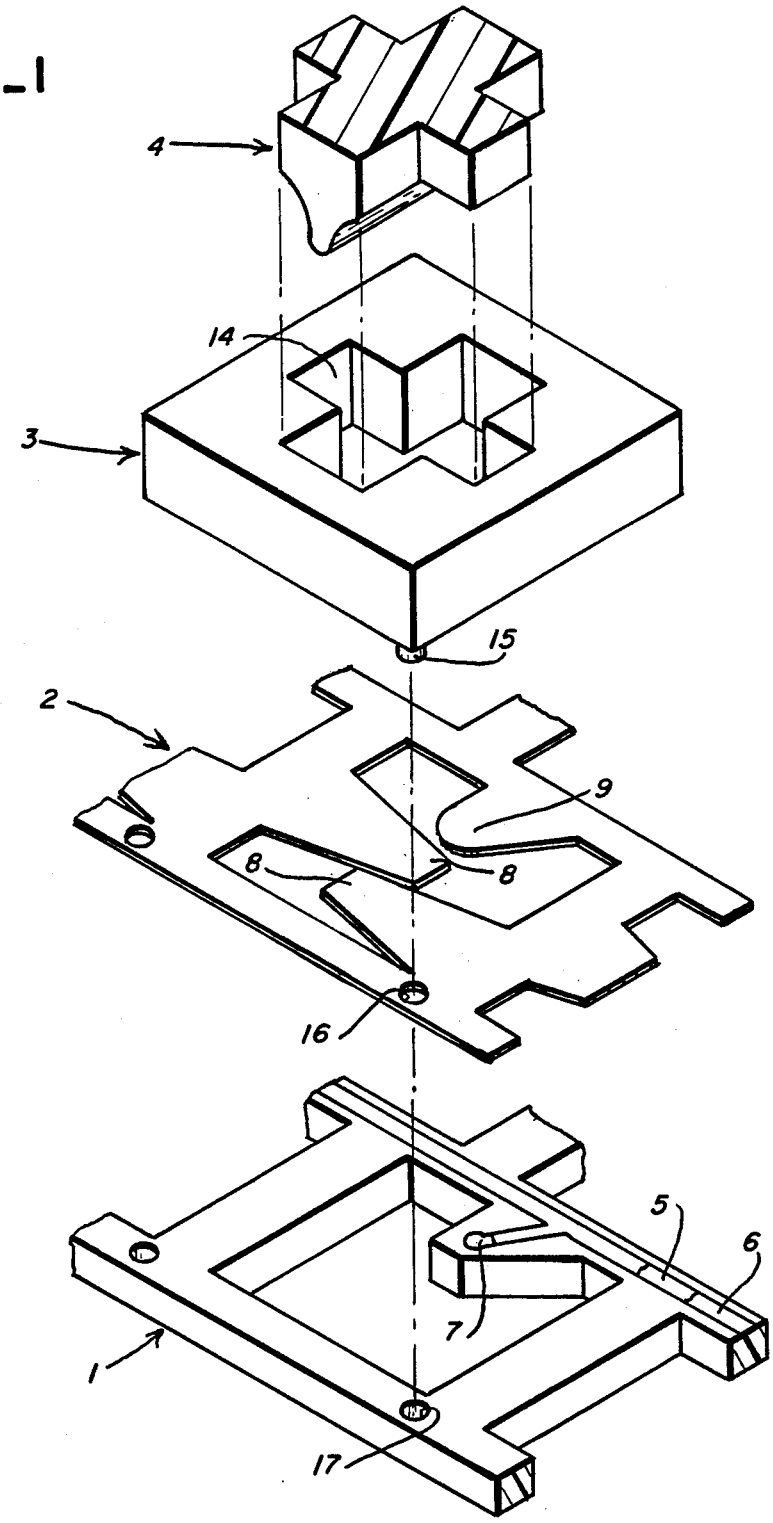
FIG. 1 is an exploded perspective view of the various unassembled parts of a key switch in accordance with the invention.

Referring now to the drawing, there is shown in FIG. 1 a key operated touch contact switch which consists essentially of a key carrier 1, a spring tongue carrier 2, a key guide 3 and a key stem 4, the latter supporting in known manner a key button not shown. The key carrier 1, the spring tongue carrier 2 and the key guide 3 may be designed so as to result in a complete keyboard, such as for a typewriter or a computer.

If the key carrier 1 consists of metal, it must be coated with an insulating layer before printed conductor 5 is applied. However, an insulating layer underlying conductor 5 is not necessary if the key carrier 1, as shown in FIG. 1, consists of an insulating plastic, for example. As shown in FIG. 1, the upper side of conductor 5 printed on insulating key carrier 1 is over coated with an insulating layer or film 6 which, however, is interrupted to expose printed conductor contact point 7. The contact points 7 may be provided with a noble metal coating to assure good transfer resistance. For example, the contact points 7 may be gold plated, or coated with graphite.

Figure 2:
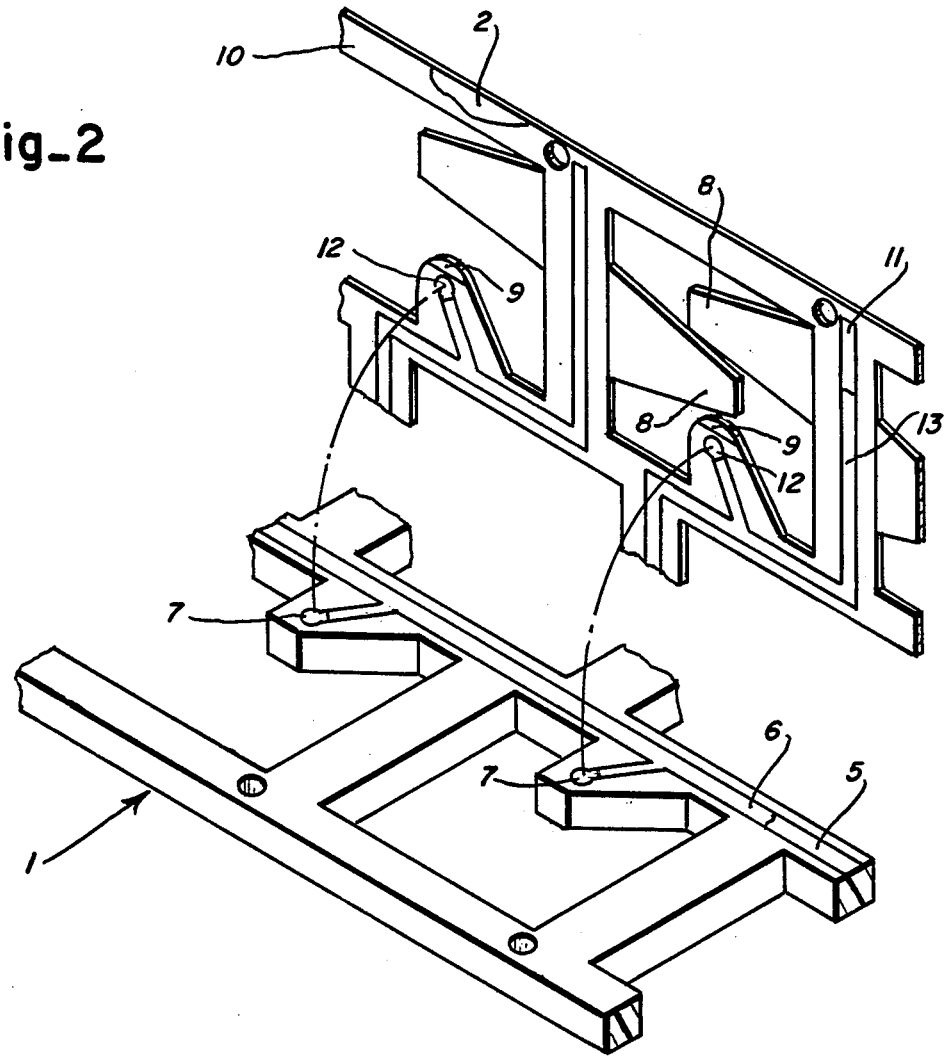
FIG. 2 is a perspective view of the key carrier and the spring tongue carrier with the latter flipped up to show its underside.

The size of the spring tongue carrier 2 is essentially the same as that of the key carrier 1. Two spring tongues 8 generating the return force for the key stem 4 are cut free for each key operated touch contact switch provided. The spring tongues 8 may be kept under a certain preload when assembled with the key stem thereby keeping the key stem raised to its uppermost position of rest which may be defined by a stop. The other spring tongue 9 is designed as a spring contact. For this purpose, with reference to FIG. 2, the under surface of the spring tongue carrier 2, i.e. the surface facing the key carrier 1 after assembly, carries, as shown in FIG. 2, a first insulating film 10, printed or coated thereon. The insulating film 10 has printed thereon a conductor 11 with contact points 12 located on each spring contact tongue 9. A further insulating film 13 is applied over the printed conductor 11 on the spring tongue carrier 2 again with interruptions to bare the contact points 12, however. The arrangement is such that, after assembly, the bare contact points 12 of the conductor 11 on the tongues 9 of the spring tongue carrier 2 are positioned exactly above the bared contact points 7 on the key carrier 1. The distance of the contact points 12 from the contact points 7 can be determined by appropriately shaping the spring tongues 9. But the distance should be kept as small as possible. After assembly of the keyboard, the insulating films 6 and 13 on the key carrier 1 and on the spring tongue carrier 2 respectively, will then bear directly on each other.

It makes sense to design the insulating films 6, 10 and 13, and also the conductors 11 in the area of the spring tongue 9 so that they are not damaged by the deformation of the spring tongue 9 occurring during a switch actuation. This means that the materials should be selected so that they have a certain elasticity, such as is known from insulating lacquers for example.

The key guide 3 has a cutout 14, shown cross-shaped in the embodiment example and serving as guide for the key stem 4. Pins 15 may be provided in the key guide 3 to engage depressions 17 in the key carrier 1 through a cutout 16 in the spring tongue carrier 2 when the completed keyboard is being mounted. This results at the same time in the defined location of the spring tongue carrier 2 relative to the key carrier 1 and the key guide 3. The parts may be screwed together, for example. It is also possible to close off the underside of the key carrier 1, resulting in a keyboard housing secured to a great extent against contamination.

In today's state of the art, the insulating films 6, 10 and 13 can be applied to the key carrier 1 or spring tongue carrier 2 in various ways. Printing or spray processes are suited for this purpose, for example. Printing of conductors 5 and 11 is also known. The last insulating films still required may again be applied by printing or spraying. The keyboard described is very simple in construction and can be assembled just as simply. Therefore, it is particularly well suited for keyboards needed in large numbers, resulting in an extremely favorable manufacturing cost.

The invention claimed is:

1. A key operated switch for keyboards comprising a key support, a first printed conductor on said support, a first insulating layer coating said first conductor except for a bared contact portion thereof, a spring having an outer configuration overlying said key support having central cutouts defining a spring contact element inwardly directed from said outer configuration and two key return springs inwardly directed from said outer configuration, a second insulating layer coating a side of said spring facing said first conductor, a second printed conductor overlying said second insulating layer, a third insulating layer covering said second conductor except for a bared contact portion thereof, a key guide overlying said spring, and a depressible key stem supported in said guide acting against said return springs and on said contact element to bring the bared contact portion of the second printed conductor into contact with said bared contact portion of said first printed conductor, thereby to connect said first and second printed conductors.

* * * * *